US007410159B2

(12) United States Patent
Miyazaki et al.

(10) Patent No.: US 7,410,159 B2
(45) Date of Patent: Aug. 12, 2008

(54) PAPER FEEDING DEVICE WITH INDEPENDENT PICKUP ROLLERS

(75) Inventors: Hiroshi Miyazaki, Inagi (JP); Tomoyuki Tamahashi, Inagi (JP)

(73) Assignees: Fujitsu Limited, Kawasaki (JP); NCR Corporation, Dayton, OH (US)

( * ) Notice: Subject to any disclaimer, the term of this patent is extended or adjusted under 35 U.S.C. 154(b) by 0 days.

(21) Appl. No.: 11/520,716

(22) Filed: Sep. 14, 2006

(65) Prior Publication Data

US 2007/0007709 A1 Jan. 11, 2007

Related U.S. Application Data

(63) Continuation of application No. PCT/JP2005/004334, filed on Nov. 3, 2005.

(30) Foreign Application Priority Data

Mar. 15, 2004 (JP) ..... 2004/073613

(51) Int. Cl.
*B65H 7/08* (2006.01)

(52) U.S. Cl. ..... 271/110; 271/153; 271/117

(58) Field of Classification Search ..... 271/113, 271/117, 265.04, 265.01, 110, 152, 153, 271/154
See application file for complete search history.

(56) References Cited

U.S. PATENT DOCUMENTS 4,395,032 A 7/1983 Hipp, Jr. ..... 271/10
4,971,304 A * 11/1990 Lofthus ..... 271/227
5,106,072 A * 4/1992 Sugiura et al. ..... 271/117
5,278,624 A * 1/1994 Kamprath et al. ..... 399/395
6,089,563 A * 7/2000 Takashimizu et al. ..... 271/117

(Continued)

FOREIGN PATENT DOCUMENTS

JP 57-160841 10/1982

(Continued)

OTHER PUBLICATIONS

Notice of Rejection Grounds mailed Apr. 24, 2007, corresponding to Japanese Patent Application (2004- 073613). Partial English-translation is enclosed.

(Continued)

*Primary Examiner*—Patrick Mackey
*Assistant Examiner*—Michael C McCullough
(74) *Attorney, Agent, or Firm*—Kratz, Quintos & Hanson, LLP.

(57) ABSTRACT

A papers feeding device, comprising first and second feeding units 10 and 20 in which pickup rollers 12 and 22 are mounted on two or more independent shafts 11 and 21 disposed on the right and left sides of the device to be orthogonal to the carrying direction of papers P. The pickup rollers 10 and 20 are vertically moved independently while following up the height position of the uppermost surface of the piled papers P. The first and second feeding units 10 and 20 are connected by a plate elastic support member 70 . The device also comprises a single optical sensor 72 for detecting the height position at the center of the elastic support member 70 . The contact state of the pickup rollers 12 and 22 with the papers P is detected based on signals detected by the optical sensor 72.

7 Claims, 8 Drawing Sheets

U.S. PATENT DOCUMENTS

| | | | | |
|---|---|---|---|---|
| 6,332,608 | B1 * | 12/2001 | Tamura | 271/111 |
| 6,866,260 | B2 * | 3/2005 | Williams et al. | 271/227 |

FOREIGN PATENT DOCUMENTS

| | | |
|---|---|---|
| JP | 62-17646 | 2/1987 |
| JP | 63-104350 | 7/1988 |
| JP | 4-179636 | 6/1992 |
| JP | 6-48594 | 2/1994 |
| JP | 7-041186 | 2/1995 |
| JP | 8-067377 | 3/1996 |

OTHER PUBLICATIONS

Korean Office Action dated Oct. 25, 2007, with English translation thereof.

* cited by examiner

PAPER FEEDING DEVICE WITH INDEPENDENT PICKUP ROLLERS

CROSS REFERENCE TO RELATED APPLICATION

This application is a continuation of PCT application PCT/JP2005/004334 which was filed on Nov. 3, 2005.

BACKGROUND OF THE INVENTION

1. Field of the Invention

The present invention relates to a papers feeding device for feeding papers, such as bills piled in an accommodation unit or the like, onto a paper path one piece by one piece, and more particularly relates to a papers feeding device with a simple configuration, capable of normally feeding papers even when there are height differences, such as undulations, slopes and the like on the uppermost surface of piled papers.

2. Description of the Related Art

For a printer, a copy machine, a bill depositing/drawing device, such as an automated teller machine (ATM) or the like, conventionally a papers feeding device for feeding papers, such as bills piled in an accommodation unit or the like, onto a paper path one piece by one piece is widely used. A general papers feeding device comprises a pair of right and left pickup rollers and a plurality of feed rollers disposed in a forward direction of these pickup rollers. In this case, each pickup roller touches the uppermost surface of the papers being orthogonal to the carrying direction of the papers and feeds them, and each feed roller sends the papers forwards.

However, sometimes height differences, such as undulations, slopes and the like due to deformation, such as creases, folding traces or the like, are generated on the uppermost surface of piled papers. In such a case, one of the pair of right and left pickup rollers does not touch the paper to cause the tilt or jam of papers. Thus, conventionally a variety of papers feeding devices in which the pair of right and left pickup rollers can touch the uppermost surface of the papers even when there are height differences, such as undulations, slopes and the like on the uppermost surface of piled papers are proposed.

For example, Japanese Patent Application Publication No. H06-48594 proposes a papers feeding device 100 in which, as shown in FIG. 7, a pair of right and left pickup rollers 111 and 112 can touch the uppermost surface of the papers P according to the inclination of the piled papers P by fixing the pair of right and left pickup rollers 111 and 112 to a shaft 120 and supporting both ends of the shaft 120 by an automatically shaft adjusting bearings 131 and 132.

Japanese Patent Application Publication No. H07-41186 proposes a papers feeding device 200 in which, as shown in FIG. 8, a supplementary support plate 211 that can be swung on both sides is provided on a tray for piling papers P and a pair of right and left pickup rollers 221 and 222 touch the uppermost surface of the papers P by tilting the supplementary support plate 211 in such a way as to kill the inclination of the uppermost surface of the papers P.

However, in the papers feeding device 100 of Japanese Patent Application Publication No. H06-48594, since the pair of right and left pickup rollers 111 and 112 are independently driven vertically, the pair of right and left pickup rollers 111 and 112 must be provided with motors 141 and 142, racks 143 and 144, springs 145 and 146, and height position detecting sensor 151 and 152, respectively to incur the complex configuration due to the increase in the number of parts and the increase of an installation space. Furthermore, the complex configuration incurs the degradation of the reliability of the device, and is not suited for a bill depositing/drawing device, such as an ATM or the like, whose operational failure must be avoided with the highest priority.

In the paper feeding device 200 of Japanese Patent Application Publication No. H07-41186,since a front guide or a means for attaching and removing additional force must be provided to hold the papers onto an unstable supplementary support plate 211, it incurs the complex configuration due to increasing the number of parts and the degradation of the reliability of the device. It is not suited for a bill depositing/drawing device, whose operational failure must be avoided with the highest priority, like Japanese Patent Application Publication No. H06-48594.

Patent Reference 1 : Japanese Patent Application Publication No. H06-48594

Patent Reference 2 : Patent Application Publication No. H07-41186

SUMMARY OF THE INVENTION

The present invention is made in order to solve the above-described problems and it is its object to provide a papers feeding device with a simple configuration, capable of touching a pair of right and left pickup rollers on papers and stably feeding them even when there are height differences, such as undulations, slopes and the like, on the uppermost surface of piled papers and also capable of improving its reliability by reduction of the number of parts.

In order to attain the objective, the papers feeding device of the present invention comprises first and second feeding units in which pickup rollers are mounted on two or more independent shafts disposed on the right and left sides of the device to be orthogonal to the carrying direction of the papers. Each of the pickup rollers is vertically moved independently while following up height differences on the uppermost surface of the piled papers.

Preferably, the first and second feeding units are connected by a plate or bar elastic support member. The device also comprises a single sensor for detecting the height position of the center of the elastic support member. The contact state of each of the pickup rollers with the papers is detected based on signals detected by the sensor.

More preferably, the device comprises a pair of guide units for regulating the right and left ends of the piled papers. Space between the guide units is specified in such a way that each of the pickup rollers can touch the piled papers even when a variety of pieces of papers with different side widths slide on both sides between the guide units.

Specifically, each end of each shaft mounted on each of the pickup rollers is connected to another shaft disposed in parallel to these shafts via respective brackets in such way as to be freely rotatable and each of the pickup rollers is vertically moved independently around the other shaft. Alternatively, the contact pressure to the papers is given to each of the pickup rollers by pressing each end of each bracket on the pickup roller side by a spring.

Furthermore, by connecting the other shaft to a drive source and conveying the driving force of the other shaft, each of the pickup rollers is rotated. Alternatively, each of the pickup rollers can also be disposed on the upper stream side in the carrying direction of papers, simultaneously the other shaft is disposed on the down stream side and a feed roller for feeding papers fed by each of the pickup rollers in the carrying direction of the papers is mounted on the other shaft.

According to the papers feeding device of the present invention, since each of a pair of right and left pickup rollers disposed to be orthogonal to the carrying direction of papers are mounted on an independent different shaft, each of the pickup rollers can be vertically moved independently while following up height differences, such as undulations, slopes and the like generated on the uppermost surface of the piled papers. Thus, the pair of right and left pickup rollers can touch the uppermost surface of the piled papers and stably feed the papers even when there are height differences on the uppermost surface of the piled papers.

When the first and second feeding units are connected by a plate or bar elastic support member, the contact state of the pair of right and left pickup rollers with the papers can be detected by a single sensor, thereby simplifying its configuration due to the reduction in the number of parts and improving its reliability.

Furthermore, when a pair of guide units for regulating the right and left ends of the piled papers is provided, by determining space between the guide units according to a variety of pieces of papers with different side widths slide, the pair of right and left pickup rollers can touch the uppermost surface of the papers and stably feed the papers regardless of the size of the papers, even when the papers side horizontally within the range of the space between guide units.

In addition to this, by a simple configuration such that the shaft of each pickup roller is connected to another shaft, such as the shaft of the existing feed roller, via a bracket in such a way as to be freely rotatable, each of the pickup rollers can be vertically moved independently, thereby reducing the number of parts of the device and improving its reliability.

By also a simple configuration such that the shaft of each pickup roller is connected to another shaft, such as the shaft of the existing feed roller, via a pulley and a timing belt, the pickup rollers can be driven, thereby further reducing the number of parts of the device and improving its reliability.

BRIEF DESCRIPTION OF THE DRAWINGS

FIG. 4 shows an optical sensor provided for the flexible plate (elastic support member) of the papers feeding device.

DESCRIPTION OF THE PREFERRED EMBODIMENTS

The papers feeding device in one preferred embodiment of the present invention is described below with reference to the drawings. In this preferred embodiment, as one example, the papers feeding device is provided as a part of a bill depositing/drawing device, such as an ATM or the like, and bills being papers are fed.

Figure 1:
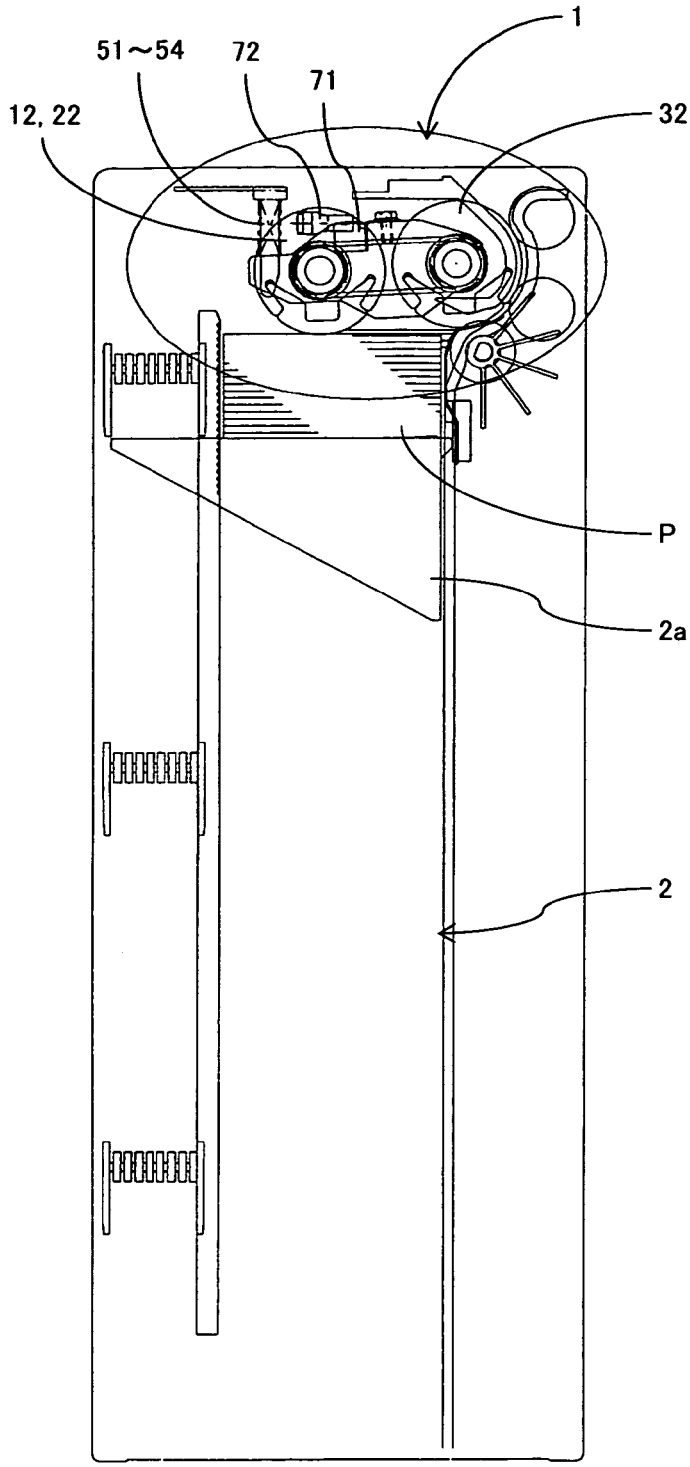
FIG. 1 shows the outline of the papers feeding device in one preferred embodiment of the present invention constituting a part of a bill depositing/drawing device.
Figure 2:
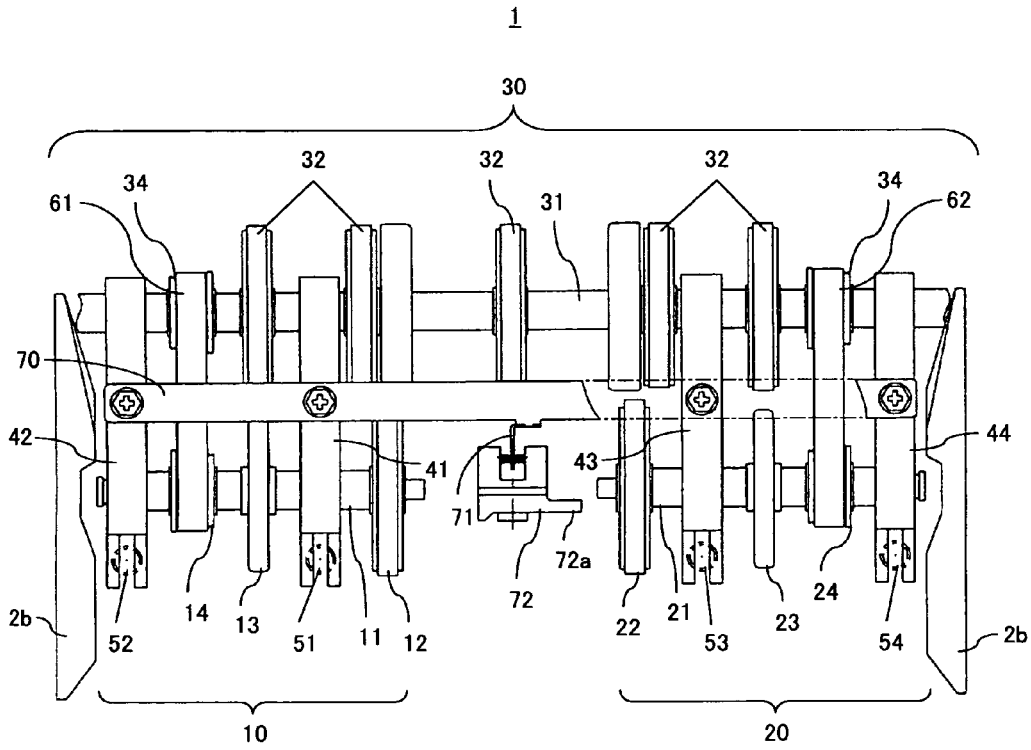
FIG. 2 is the top view of the papers feeding device.
Figure 3:
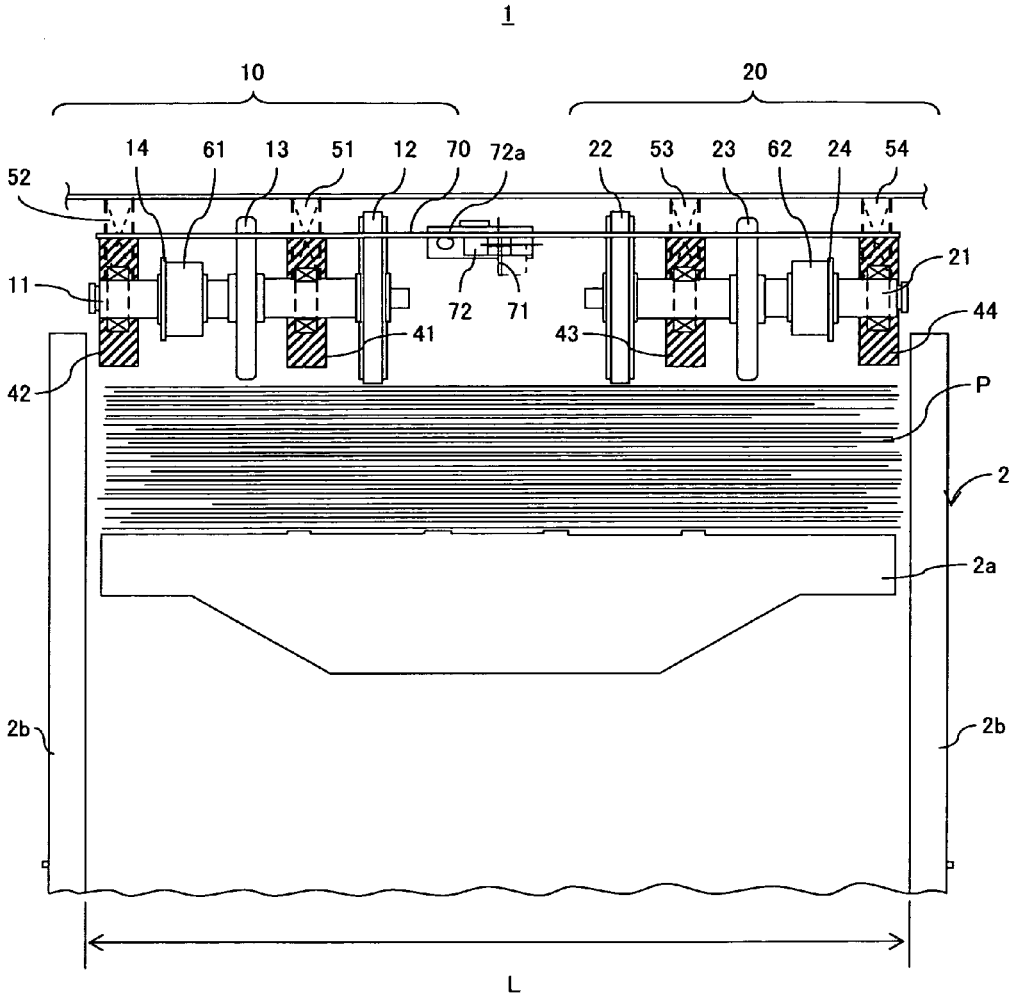
FIG. 3 is the partial section front view of the papers feeding device.
Figure 4A:
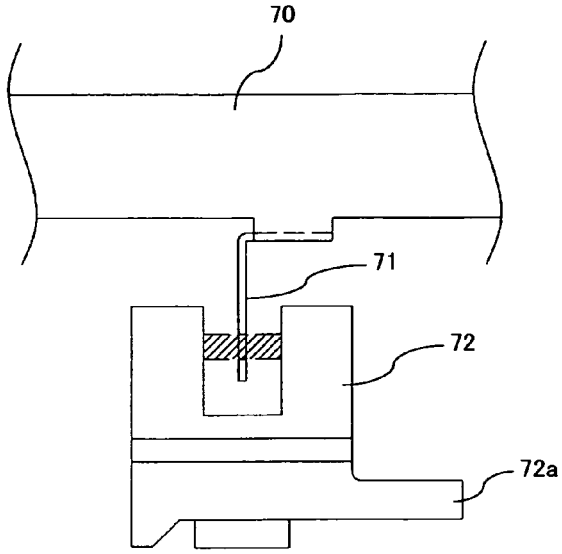
FIGS. 4A, 4B and 4C are its top view, front view and side view, respectively.
Figure 4B:
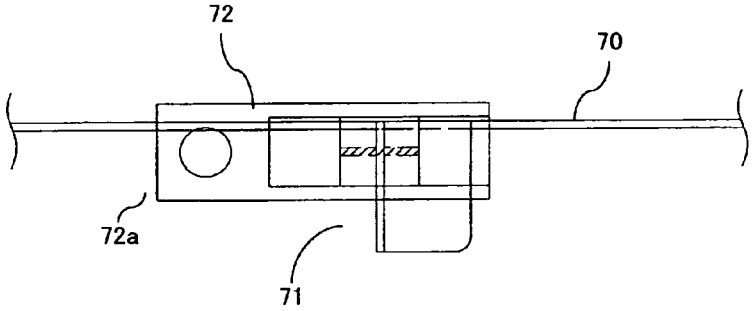
Figure 4C:
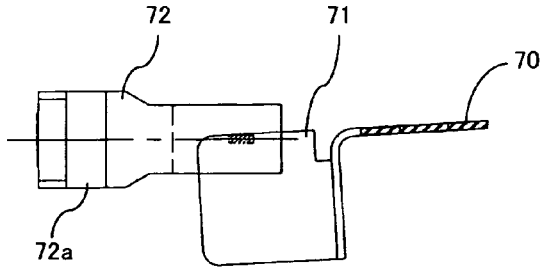
Figure 5:
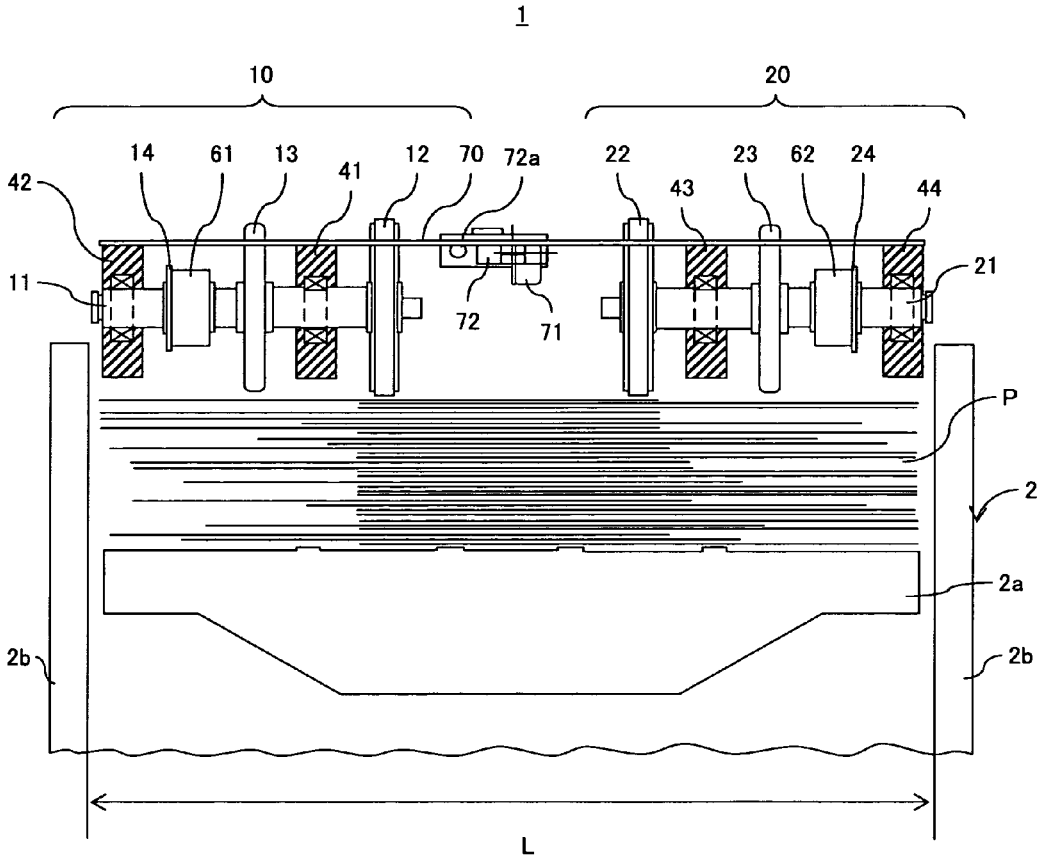
FIG. 5 is the partial section front view of the papers feeding device, showing the state where bills (papers) of a variety of sizes are regulated by a guide unit.

FIG. 1 shows the outline of the papers feeding device in one preferred embodiment of the present invention constituting a part of a bill depositing/drawing device. FIGS. 2 and 3 are the top view and partial section front view of the papers feeding device. FIG. 4 shows an optical sensor provided for the elastic support member of the papers feeding device. FIGS. 4A, 4B and 4C are its top view, front view and side view, respectively. FIG. 5 is the partial section front view of the papers feeding device, showing the state where bills (papers) of a variety of sizes are regulated by a guide unit.

In FIGS. 1-3, reference numeral 1 is the papers feeding device of this preferred embodiment, which is disposed above a bill cassette 2 for piling and accommodating bills (papers) P. the papers feeding device 1 mainly comprises first and second feeding nits 10 and 20 disposed on the upper stream side of the carrying direction of the bills P and an output unit 30 disposed on the down stream side. In the papers feeding device 1, each feed roller 32 of the output unit 30 outputs bills P fed by the pickup rollers 11 and 22 of the first and second feeding units 10 and 20, respectively, to a paper path, which is not shown in FIGS. 1-3.

The first and second feeding units 10 and 20 have the same bisymmetric structure, in which pickup rollers 12 and 22, guide rollers 13 and 23, and pulleys 14 and 24 are mounted on different independent shafts 11 and 21, respectively.

In the first and second feeding units 10 and 20, each end of the shafts 11 and 12 is connected to the shaft (another shaft) 31 of the output unit 30 via brackets 41 and 42, and 43 and 44, respectively, in such a way as to be freely rotatable. Thus, the first and second feeding units 10 and 20 can be vertically moved independently around the shaft 31.

Furthermore, by pressing one ends of the brackets 41 and 42, and 43 and 44 of the first and second feeding units 10 and 20 by the springs 61 and 63, and 62 and 64, respectively, the contact pressure to the papers P is given to each of the pickup rollers 12 and 22.

In the output unit 30, five feed rollers 32, 32, 32, 32 and 32 and two pulleys 34 and 34 are mounted on a piece of long shaft 31. Each end of the shaft 31, is supported rotationally by a bearing, which is not shown in FIGS. 1-3. The shaft 31 receives the driving force of a motor and rotates. The driving force of the shaft 31 is conveyed to the shafts 11 and 21 by connecting the pulleys 34 and 34 to the pulleys 14 and 24 by the timing belts 61 and 62, respectively. Thus, each of the pickup rollers 12 and 22 is synchronized with each feed roller 32 and driven.

In this preferred embodiment, the first and second feeding units 10 and 20 which can be vertically moved are connected by a flexible plate (elastic support member) 70 being a long flexible plate member. The flexible plate 70 is a metal or synthetic resin plate spring with thickness of approximately 0.5 mm and can be flexibly bent according to the vertical movement of the first and second feeding units 10 and 20.

As shown in FIGS. 4A-4C, a flag 71 projects at the center of the flexible plate 70. By an optical sensor 72 which is in concave shaped when viewed from the top detecting the height position of the flag 71, the contact state of each of the pickup rollers 12 and 22 with the papers P is detected. The optical sensor 72 is fixed at a constant height by screwing its flange 72*a* on a frame or the like, which is not in FIG. 4.

Although such a flexible plate 70 is used to detect the contact state of each of the pickup rollers 12 and 22 with the papers P, it also generates light repulsive force and gives appropriate contact pressure to the papers P, when each of the pickup rollers 12 and 22 touches the papers and a flexible plate 70 is bent.

The flexible plate 70 is not limited to a plate as long as it can flexibly bend according to the vertical movement of each of the pickup rollers 12 and 22. For example, it can be a flexible bar.

As shown in FIG. 1, the bill cassette 2 comprises a rising/falling stage 2*a* which can vertically carry piled bills P while mounting them. As shown in FIGS. 2 and 3, a pair of guide units 2*b* and 2*b* for regulating each side of the piled bills P are provided on each side of the rising/falling stage 2*a*. In this preferred embodiment, space L between the guide units 2*b* and 2*b* is predetermined in such a way that a pair of right and left pickup rollers 12 and 22 can touch the uppermost surface of the bills P even when various types of bills of different side widths (for example, domestic and foreign bills) P slide between the guide units 2*b* and 2*b* on the rising/falling stage 2*a* (see FIG. 5).

Next, the operation of the papers feeding device 1 with such a configuration is described with reference to FIG. 6.

Figure 6:
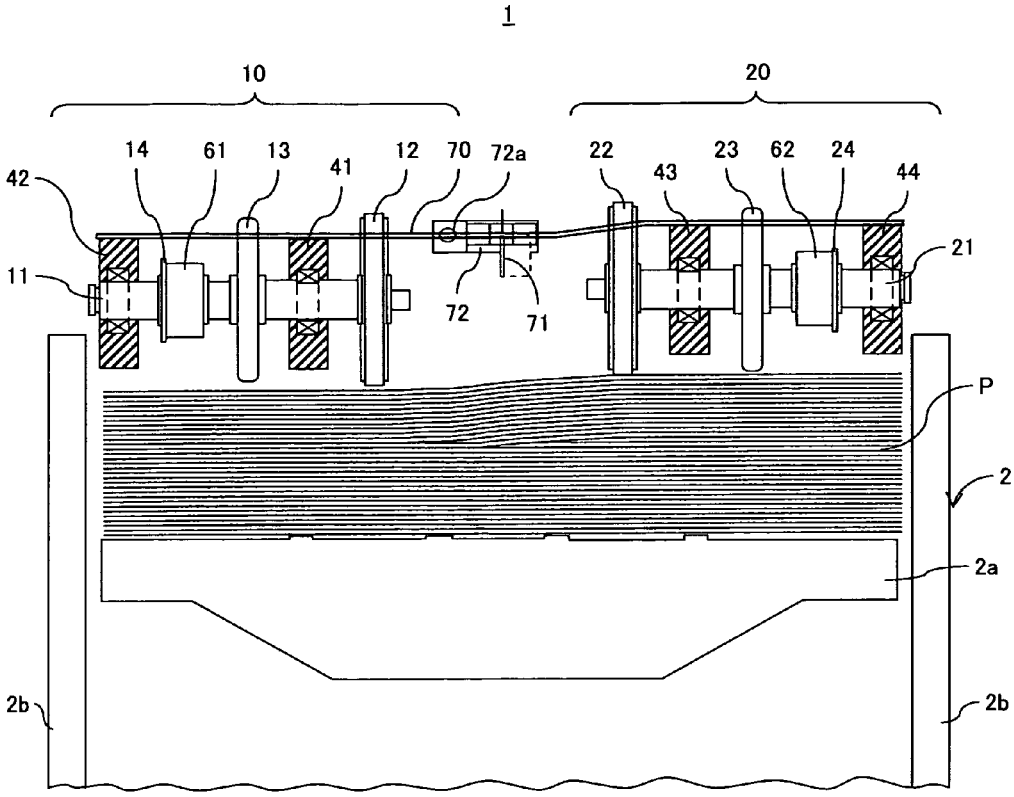
FIG. 6 is a partial section front view showing the operation of the papers feeding device in the case where the uppermost surface of a piled bills (papers) is inclined.
Figure 7:
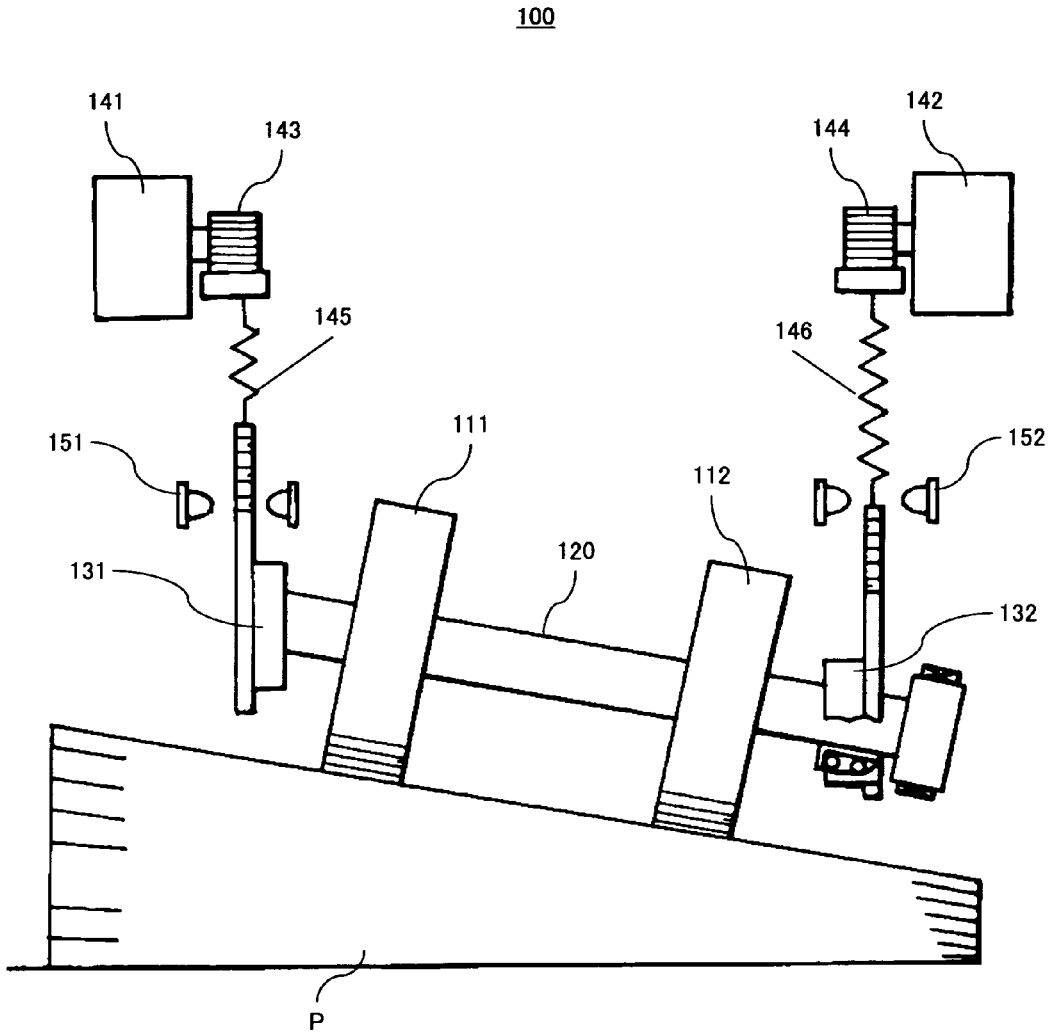
FIG. 7 is a front view showing the major part of one conventional papers feeding device.
Figure 8:
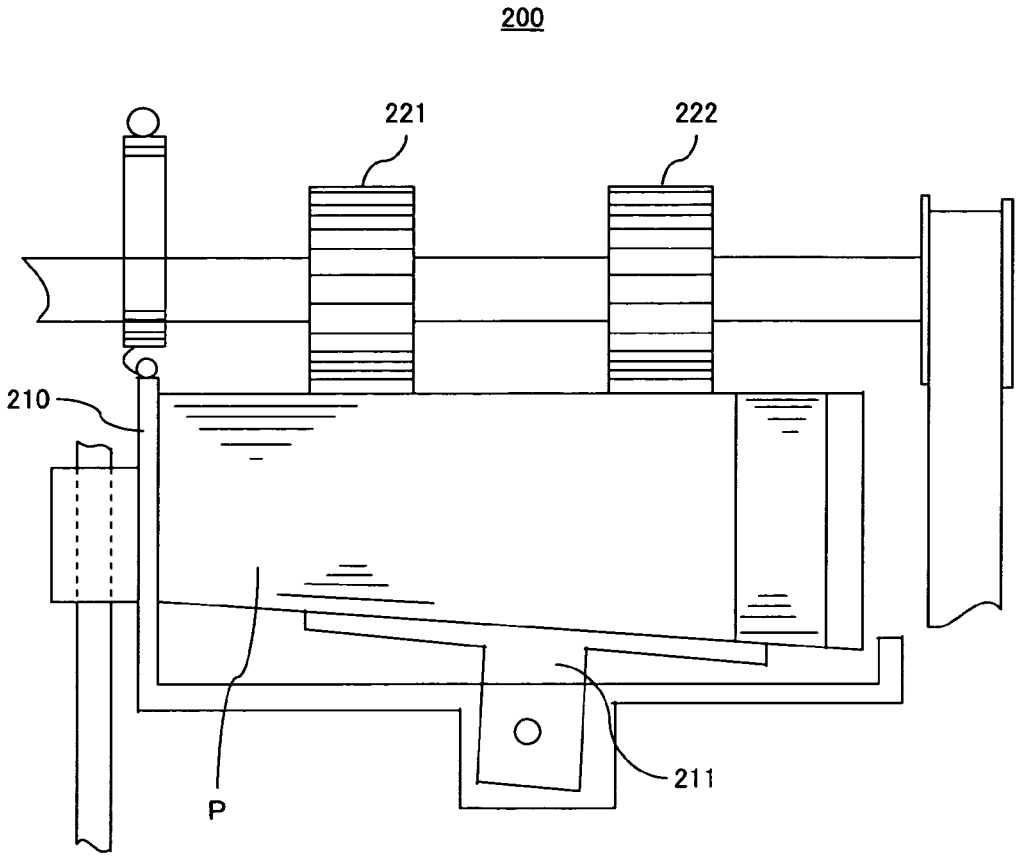
FIG. 8 is the front view showing the major part of another conventional papers feeding device.

FIG. 6 is a partial section front view showing the operation of the above-described papers feeding device in the case where the uppermost surface of a piled bills (papers) is inclined.

As shown in FIG. 6, even if the uppermost surface of piled bills P is inclined and height differences are generated between both sides, only the first feeding unit 10 located on the left side follows up the height differences due to the pressure of springs 51 and 52 and the pickup roller 12 on the left side touches the uppermost surface of the bills P. If the pair of right and left pickup rollers 12 and 22 touches the uppermost surface of the bills P, the flag 71 shades the optical sensor 72 from light, as a result, a control unit, which is not shown in FIG. 6, outputs a signal to a motor to drive the pair of right and left pickup rollers 12 and 22 and each feed roller 32 and to feed and output the bills P.

If the uppermost surface of the piled bills P is remarkably inclined and only one of the pickup rollers 12 and 22 touched the bills P, only one end of the right and left flexible plate 70 is sharply bent downward and the flag 71 provided at the center of the flexible plate 70 is greatly moved downward to transmit light through the optical sensor 72.

Then, the control unit raises the rising/falling stage 2*a* to touch the pair of right and left pickup rollers 12 and 22 on the uppermost surface of the bills P. Then, the bending of the flexible plate 70 is mitigated and the flag 71 shades the optical sensor 72 from light.

Then, the control unit stops the rising/falling stage 2*a* from rising and outputs a signal to the motor, which is not shown in FIG. 6, to drive the pair of right and left pickup rollers 12 and 22 and each feed roller 32 and to feed and output the bills P.

According to the papers feeding device 1 of such a preferred embodiment, since a pair of right and left pickup rollers 12 and 22 disposed to be orthogonal to the carrying direction of bills P are mounted on different independent shafts 11 and 21, respectively, the pickup rollers 12 and 22 can follow up height differences, such as undulations, slopes and the like, generated on the uppermost surface of the piled bills P and be vertically moved independently. Thus, even when there are height differences on the uppermost surface of the piled bills P, the pair of right and left pickup rollers 12 and 22 can touch the uppermost surface of the bills P and stably feed the bills P.

By connecting the first and second feeding units by a flexible plate 70, the contact state of the pair of right and left pickup rollers 12 and 22 with the bills P can be detected by the single optical sensor 72, based on the height position at the center of the flexible plate 70, thereby simplifying its configuration due to the reduction in the number of parts and improving its reliability.

Furthermore, by determining space between a pair of guide units 2*b* and 2*b* for regulating both side ends of piled bills P, according to various types of bills P with different side widths, the pair of right and left pickup rollers 12 and 22 can touch the uppermost surface of the bills P and stably feed the bills P regardless of the size of a bill P, even when these bills P are horizontally displaced within the range of the space L.

In addition to this, in this preferred embodiment, by a simple configuration such that the shafts 11 and 21 of the pickup rollers 12 and 22, respectively, are connected to the shaft 31 of the existing feed roller 32 via brackets 51-54, the pickup rollers 12 and 22 can be vertically moved independently, thereby reducing the number of parts of the device and improving its reliability.

By a simple configuration such that the shafts 11 and 21 of the pickup rollers 12 and 22 are connected to the shaft 31 of the existing feed roller 32, via the pulleys 14 and 24, and 34 and 34, and the timing belts 61 and 62, respectively, the pickup rollers 12 and 22 can be driven, thereby reducing the number pf parts of the device and improving its reliability.

The application of the papers feeding device of the present invention is not limited to the above-described preferred embodiment. For example, although in the above-described preferred embodiment the papers feeding device 1 is used as a part of a bill depositing/drawing device, such as an ATM or the like, its application is not limited to this and can also be widely used to feed papers, such as bankbooks, tickets, merchandise coupons, checks, credit cards, bonds, debentures and the like.

What is claimed is:

1. A papers feeding device with independent pickup rollers, compnsing:

first and second feeding units in which the pickup rollers are mounted on two or more independent shafts disposed on the right and left sides of the device to be orthogonal to the carrying direction of the papers, wherein each of the pickup rollers is vertically moved independently to varying positions while following up height differences on an uppermost surface of piled papers, and the first and second feeding units are connected by a plate elastic support member or a bar elastic support member, wherein a sensor for detecting a height position of the elastic support member is provided and a contact state of each of the pickup rollers and papers is detected based on the detected signal of the sensor.

2. The papers feeding device with independent pickup rollers according to claim 1, wherein the sensor detects a height position at the center of the elastic support member.

3. The papers feeding device according to claim 1, wherein a pair of guide units for regulating right and left ends of piled papers is provided and space between the guide units is determined in such a way that the pair of pickup rollers can touch the papers even when various types of papers with different side widths displace to both sides between the guide units.

4. The papers feeding device according to claim 1, wherein both ends of a shaft mounted with each of the pickup rollers are connected to another shaft disposed in parallel to the shafts via respective brackets in such a way as to be freely rotatable, and each of the pickup rollers is vertically moved independently around the other shaft.

5. The papers feeding device according to claim 4, wherein contact pressure to the papers is given to each of the pickup rollers by pressing an end on the pickup roller side of each of the brackets by a spring.

6. The papers feeding device according to claim 4, wherein the other shaft is connected to a driving source and each of the pickup rollers is rotated by the driving force being conveyed.

7. The papers feeding device according to claim 4, wherein each of the pickup rollers is disposed on the upper stream side in the carrying direction of papers, the other shaft is disposed on the down stream side and a feed roller for outputting the papers fed by each of the pickup rollers, is mounted on the other shaft.

* * * * *

UNITED STATES PATENT AND TRADEMARK OFFICE

CERTIFICATE OF CORRECTION

PATENT NO. : 7,410,159 B2
APPLICATION NO. : 11/520716
DATED : August 12, 2008
INVENTOR(S) : Miyazaki et al.

It is certified that error appears in the above-identified patent and that said Letters Patent is hereby corrected as shown below:

On the Cover Page in item (63)

Please change "Nov 3, 2005" to read --March 11, 2005--.

Signed and Sealed this

Seventeenth Day of March, 2009

John Doll

JOHN DOLL
*Acting Director of the United States Patent and Trademark Office*